US008538094B2

(12) United States Patent
Roizen et al.

(10) Patent No.: US 8,538,094 B2
(45) **Date of Patent: *Sep. 17, 2013**

(54) SYSTEM AND METHOD FOR DETERMINING AN OBJECTIVE MEASURE OF HUMAN QUALITY OF LIFE

(75) Inventors: Michael F. Roizen, Shaker Heights, OH (US); Mehmet C. Oz, Cliffstreet Park, NJ (US); Jennifer L. Roizen, Menlo Park, CA (US); Jeffrey D. Roizen, Philadelphia, PA (US)

(73) Assignee: Youdocs Beauty, Inc., New York, NY (US)

( * ) Notice: Subject to any disclaimer, the term of this patent is extended or adjusted under 35 U.S.C. 154(b) by 141 days.

This patent is subject to a terminal disclaimer.

(21) Appl. No.: 13/214,945

(22) Filed: Aug. 22, 2011

(65) Prior Publication Data

US 2012/0215790 A1 Aug. 23, 2012

Related U.S. Application Data

(63) Continuation-in-part of application No. 12/101,190, filed on Apr. 11, 2008, now Pat. No. 8,005,270.

(51) Int. Cl.
*G06K 9/00* (2006.01)
*G06K 9/46* (2006.01)

(52) U.S. Cl.
USPC ..... 382/118; 382/192; 382/203

(58) Field of Classification Search
USPC ..... 382/118, 192, 206
See application file for complete search history.

(56) References Cited

U.S. PATENT DOCUMENTS

| | | | | |
|---|---|---|---|---|
| 6,091,836 | A * | 7/2000 | Takano et al. | 382/118 |
| 7,286,692 | B2 * | 10/2007 | Kanarat | 382/118 |
| 2005/0144029 | A1 * | 6/2005 | Rakowski et al. | 705/1 |
| 2008/0270175 | A1 | 10/2008 | Rodriguez et al. | |

OTHER PUBLICATIONS

Eisenthal et al., "Facial Attractiveness: Beauty and the Machine," Neural Computation 18, 2006, pp. 119-142.
Gunes et al., "Assessing Facial Beauty Through Proportion Analysis by Image Processing and Supervised Learning," International Journal of Human-Computer Studies 64, Sep. 15, 2006, pp. 1184-1199.

* cited by examiner

*Primary Examiner* — Utpal Shah
(74) *Attorney, Agent, or Firm* — The Marbury Law Group, PLLC

(57) ABSTRACT

An objective measure of human QOL is determined by a QOL quantification system. The QOL quantification system comprises a QOL rules engine, a QOL measure datastore, a score data archive, a user computing device, and a network. The QOL measure datastore comprises quantifiable measures of QOL of a QOL factor. The QOL rules engine comprises instructions for receiving user data indicative of a plurality of attributes of a selected QOL factor of the user, obtaining measures of QOL from the QOL measures datastore associated with the selected QOL factor, evaluating the user data against the QOL measures of the selected QOL factor, determining a user score indicative of the QOL of the selected QOL factor of the user, storing the user score in the score data archive, and comparing the user score to a score stored in the score data archive. The QOL rules engine may also suggest change options to one or more QOL factors to improve the user score. The suggested change options may be presented as an ordered listed organized by a relative cost benefit measure.

15 Claims, 5 Drawing Sheets

SYSTEM AND METHOD FOR DETERMINING AN OBJECTIVE MEASURE OF HUMAN QUALITY OF LIFE

BACKGROUND

Quality of life ("QOL") is commonly defined as the level of enjoyment, comfort and health in a person's life. QOL is studied as part of psychology, sociology, social psychology and culture. QOL, as a cultural creation, is also extremely commercialized.

In a subjective sense, QOL is determined by factors that are perceived in such a way as to provide a person with an overall feeling of happiness and general sense of well being and satisfaction. Determinations of quality of life are highly subjective and individualized, as different individuals will value particular aspects of their life more than others will value those same aspects in their own lives.

Thus an objective QOL measure is difficult to define. Various indices exist which attempt to measure the quality of life of an individual or aggregate quality of life of a population. These indices are based on a number of factors, some of which are highly subjective, such as surveys of people's perception of their family life, while others are more objective, such as statistical data of average household income in a given region.

SUMMARY

Embodiments disclosed herein utilize mathematical models of idealized lifestyle factors to provide an objective measure of QOL of those factors and an objective comparison of an individual's QOL measures to known individuals or groups of individuals.

DETAILED DESCRIPTION

In an embodiment, a QOL quantification system (QQS) receives data on selected QOL factor in digital form. The QQS comprises a rules engine that evaluates the digital data against measures of QOL associated with the selected factor and provides a QOL score based on the results. By way of illustration and not as a limitation, QOL scores may be obtained for sleep measures, relationship measures, mental health measures, nutrition measures, fitness measures, physical appearance measures, and physical health measures. Scores from each QOL factor are normalized to allow scores to be combined to produce a composite QOL score. A composite QOL score may be compared against an absolute standard, against people considered to have desirable QOL, against people considered to have undesirable QOL, or compared to one or more friends or acquaintances.

By way of illustration, in an embodiment, the selected QOL factor is physical fitness and the QQS receives data relating to various measures of physical fitness of an individual in digital form. The QQS evaluates the digital data against standardized measures of physical fitness and provides a QOL score based on the results. In an embodiment, the measures of physical fitness comprise height to weight ratio, type, amount and frequency of exercise, resting heart rate, respiratory volume, etc.

The digital data relating to the selected factor may be modified and the modified data evaluated by the QQS to determine the effect of the changes on the QOL score.

Figure 1:
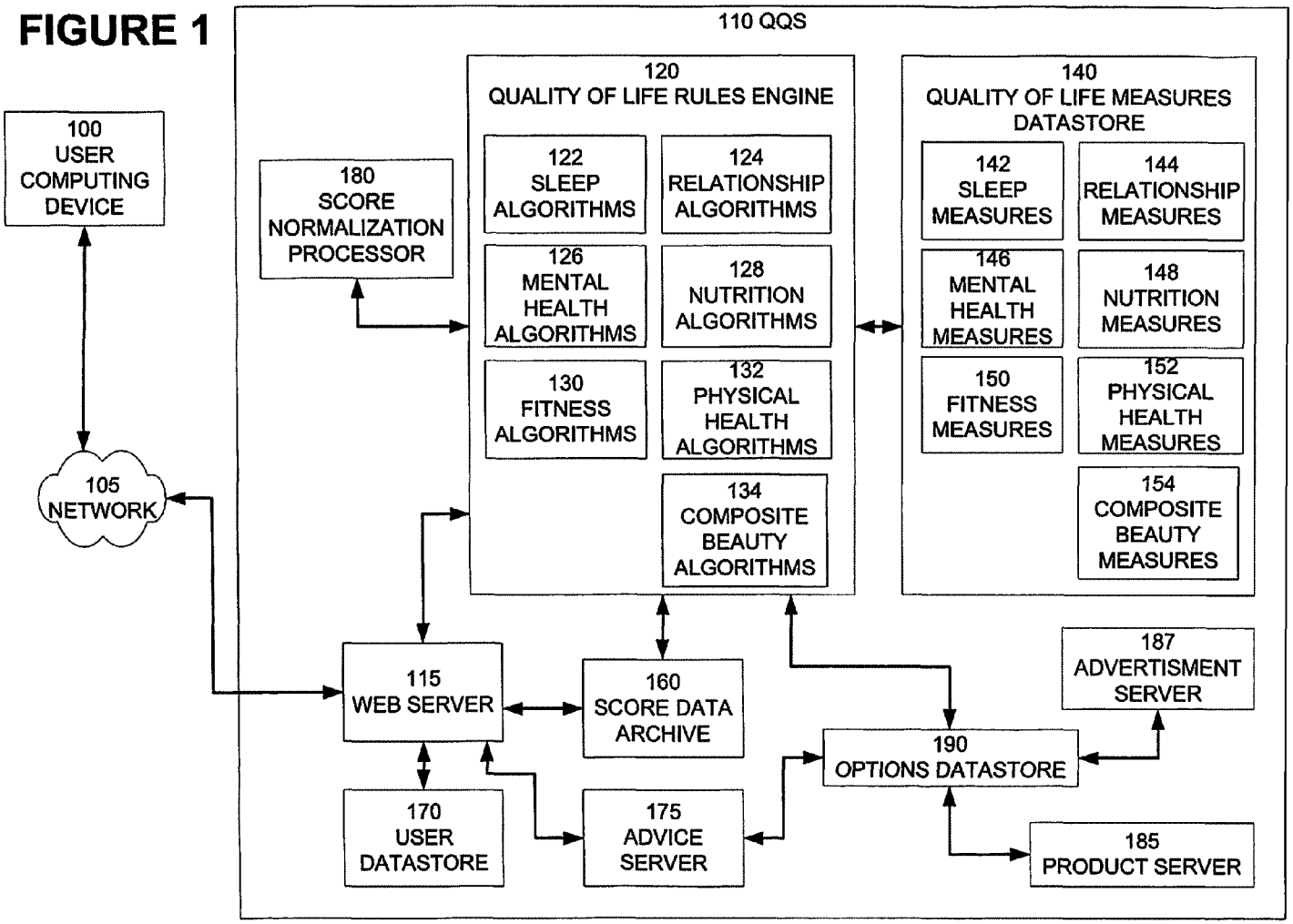
FIG. 1 illustrates the logical elements of a QQS according to an embodiment.

FIG. 1 illustrates the logical elements of a QQS according to an embodiment.

QQS 110 comprises a QOL rules engine 120, a QOL measures datastore 140, and a score normalization processor 180. A user computing device 100 connects to QQS 110 via network 105.

In an embodiment, network 105 is the Internet. However, this is not meant to be a limitation. For example, network 105 may be a local area network such as, for example, a LAN operating at a kiosk in a shopping mall or a LAN operating within a health club wherein clientele have access to the embodiments illustrated herein. Alternatively, network 105 may be managed IP network such as, for example, a cable or fiber subscriber access network.

User computing device 100 interacts over the network with the QQS 110 and may be computer, a PDA, a cell phone, or other device capable of sending data over network 105. In an embodiment, user computing device 100 is located at a kiosk in a shopping mall, at a location within a health club or other locations. In yet another embodiment, user computing device 100 is located in a retailer's establishment and enables a customer to access the QQS 110 as a service to assist the customer in goods and services designed to improve one or more of the QOL factors.

QOL rules engine 120 receives data for a selected QOL factor from user computing device 100. The QOL measures for the selected QOL factor are stored in QOL measures datastore 140. The QOL rules engine 120 retrieves the QOL measures associated with the selected QOL factor from QOL measures datastore 140 and applies an algorithm appropriate to the selected QOL factor to the data and the QOL measures to produce a QOL score for the selected QOL factor. QOL scores for various QOL factors are normalized by the score normalization processor 180 thereby creating a common reference for the various QOL factors. Based on these normalized scores, a composite QOL score of all selected QOL factors may be produced.

As illustrated in FIG. 1, QOL measure datastore 140 comprises sleep measures 142, relationship measures 144, mental health measures 146, nutrition measures 148, fitness measures 150, physical health measures 152, and composite beauty measures 154 derived in a fashion as identified in U.S. patent application Ser. No. 12/101,190 (to be issued Aug. 23, 2011 as U.S. Pat. No. 8,005,270) which is incorporated herein by reference specifically for its disclosure of how to measure and compare physical measurements of beauty. QOL quantification processor 120 comprises sleep algorithms 122, relationship algorithms 124, mental health algorithms 126, nutrition algorithms 128, fitness algorithms 130, physical health algorithms 132, and composite beauty algorithms 134 derived in a fashion as identified in U.S. patent application Ser. No. 12/101,190 (to be issued Aug. 23, 2011 as U.S. Pat. No. 8,005,270) which is incorporated herein by reference specifically for its disclosure of algorithms for quantifying beauty based on physical measurements. The QOL measures and algorithms illustrated in FIG. 1 are exemplary and not limiting. For example, other measure/algorithm combinations may include household income, community life, job security, and so on.

Web server 115 provides a web page comprising a graphical user interface (GUI) to user computing device 100. Web server 115 communicates with user datastore 170 to store and retrieve user data, results, scores and other related information. In an embodiment, a user is identified by a user identifier. Web server 115 operates with user datastore 170 to permit a user to retrieve previously stored information and to compare the user's scores to the scores of other users identified through the user identifier or to the scores of exemplary persons of interest as set forth below.

Web server 115 also interacts with QOL rules engine 120 and with score data archive 160. Score data archive 160 comprises scores of celebrities, historical figures, ideal lifestyle measures and averages of lifestyle measure scores for a given community. As described further below, the web server 115 operates with score data archive 160 to permit a user to compare scores of the user with scores of people stored in the score data archive 160.

In an embodiment, web server 115 interacts with advice server 175 to provide suggestions for improving scores based upon the individual QOL scores at any point in time.

In an embodiment, web server 115 interacts with advice server 175 to provide product recommendations from product server 185 specific to the suggested improvements.

In an embodiment, web server 115 interacts with advice server 175 to provide targeted advertisements served by advertisement server 187 specific to the suggested improvements.

Figure 2:
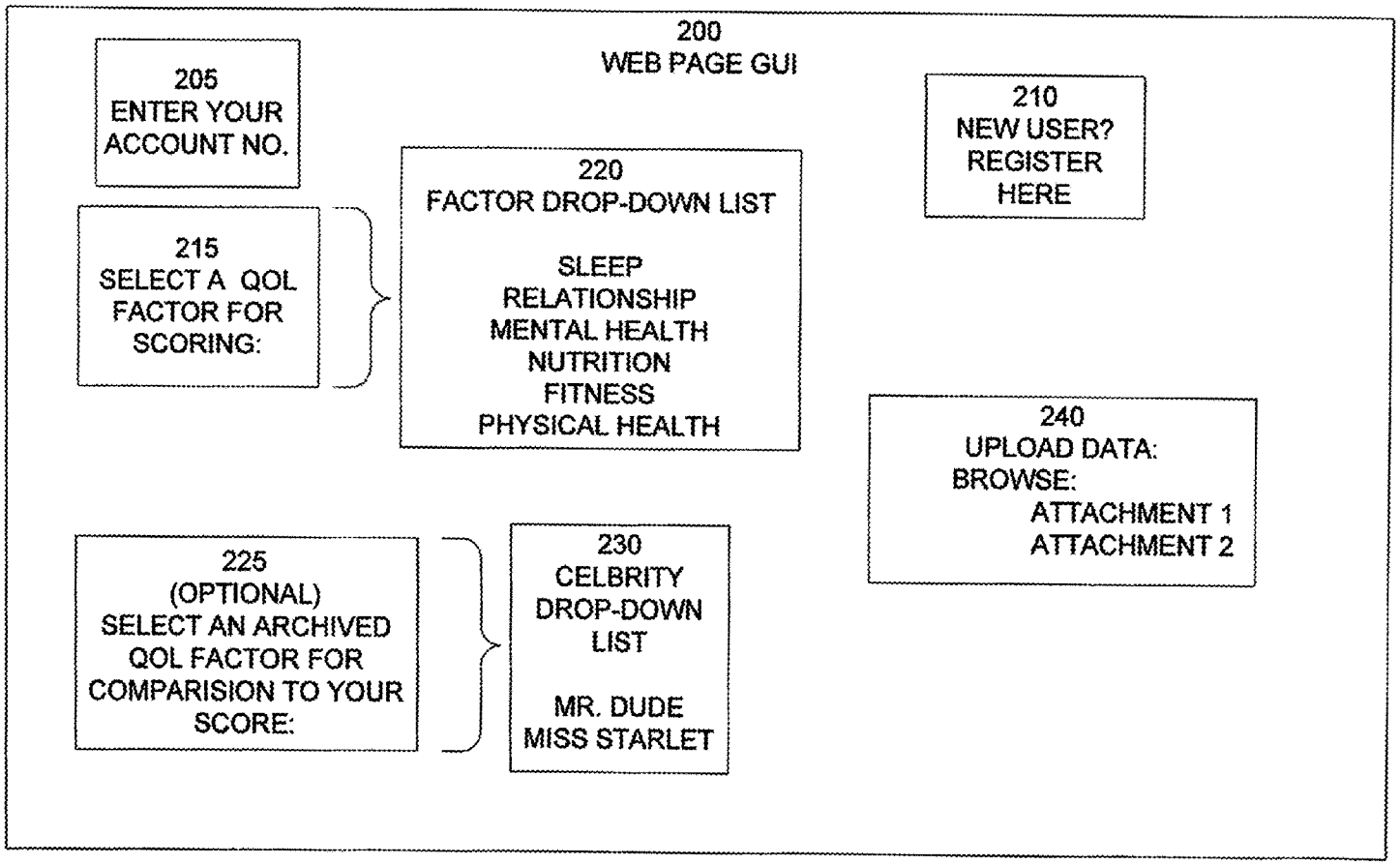
FIG. 2 illustrates a GUI according to an embodiment hereof.

FIG. 2 illustrates a GUI according to an embodiment hereof. Web page GUI 200 provides interactive links for communicating with QQS 110 (FIG. 1). Link 205 permits entry of an account number for a returning user. A new user may register with web server 115 (FIG. 1) using link 210. A user selects a QOL factor for scoring using link 215. Selecting this link causes a factor drop-down list 220 to be presented. The user then selects the QOL factor for scoring from the drop-down list. Data relevant to the selected QOL factor are then uploaded using link 240. Link 240 comprises browse and load functionality to permit a user to find the appropriate data on user input device 100 (FIG. 1) and attach them for sending to web server 115 (FIG. 1).

In an embodiment, a user may optionally use link 225 to select archival data from a drop-down list 230 so that the user's score may be compared with known data. Archival data may be provided for celebrities, historical figures, ideal lifestyle measures and averages of lifestyle measure scores for a given community.

As described above, a user may change the measures of a QOL factor and submit data related to the changed factor for quantification by the QOL quantification processor 120. For example, the user's exercise regimen may be changed to determine what effects the changes may have on the QOL score.

Figure 3:
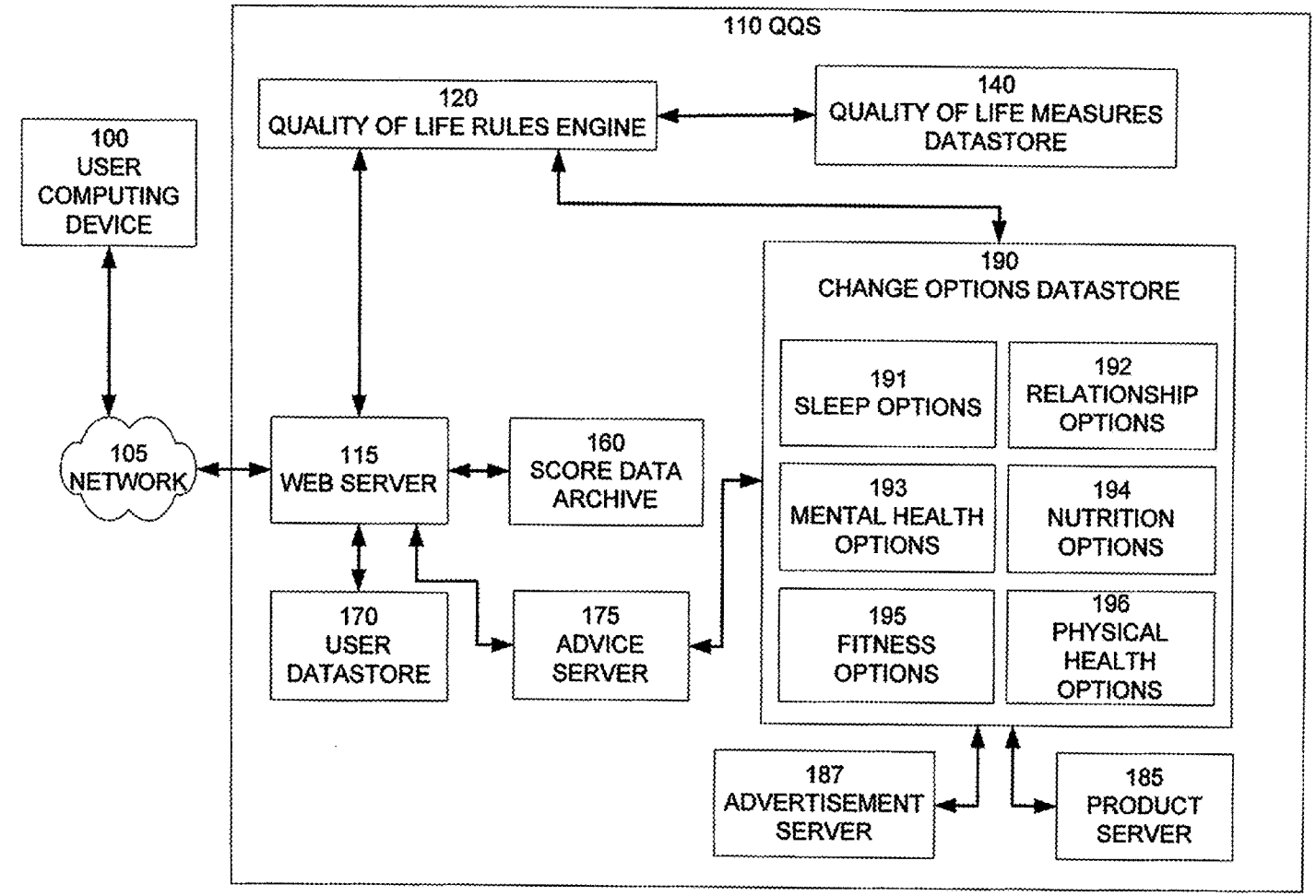
FIG. 3 illustrates the logical elements of a QOL quantification system comprising a QOL options datastore according to an embodiment.

FIG. 3 illustrates a QOL quantification system comprising a change options datastore 190 according to an embodiment that comprises a plurality of options for changing a plurality of QOL factors. The QOL rules engine 120 automates and optimizes a QOL score by applying one or more change options retrieved from the change options datastore 190 to a selected QOL factor that are above a specified score value or that improve a score value by a specified amount or percentage. As illustrated, change options datastore 190 comprises selectable change options for sleep 191, relationships 192, mental health 193, nutrition 194, fitness 195 and physical health 196. However, this is not meant as a limitation. The change options datastore may provide selectable change options for any QOL factors for which QOL scores may be calculated.

By way of illustration, physical fitness plays an important role in overall quality of life. Varying exercise regimens can be implemented which take an individual's age, gender, and current overall physical fitness level into account and provides demonstrable and quantifiable increases in physical fitness.

The QOL change engine 120 can be configured to provide "before" and "after" scores for selected change options. For example, a user provides data for evaluation by the QOL change engine 120 and receives a QOL score. The user may select, via a GUI (not illustrated) served by web server 115, change options to be applied to the provided data for evaluation. Thus, the user may select different exercise or other fitness regimens and see how each will change their overall QOL score.

Alternatively, the user may request that QOL rules engine 120 select change options from change options datastore 190 that affect the QOL score in a certain way. QOL change engine 120 selects change options from change options datastore 190 for the selected QOL factor, in this example, physical fitness enhancements 195, and processes those enhancements through QOL change engine 120. The resulting scores and change options are provided by web server 115 to user computing device 100.

In an embodiment, the QOL rules engine further provides the user an ordered list of the one or more identified change options organized by relative improvement in the user score. In still another embodiment, for each of the one or more identified change options, the QOL rules engine determines a cost benefit measure indicative of a unit of improvement to the user score to be derived from an identified change option to a cost of implementing the identified change option. The user is provided an ordered list of the identified change options organized by the relative cost benefit measure of each of the identified change options.

In another embodiment, the user provides the QOL rules engine data relating to a number of QOL factors, and the QOL change engine provides the user a composite score indicative of the overall QOL of the user. As previously described, the user may request that the composite score be recalculated based on selected change options selected from the change options datastore to one or more QOL factors of the user. Alternatively, the QOL rules engine may assess the user data and scores and present the user with an ordered list of identified change options from the change options datastore that will improve the user's composite score. In an embodiment, the list is organized by relative improvement in the user score. In still another embodiment, for each of the one or more identified change options, the QOL rules engine determines a cost benefit measure indicative of a unit of improvement to the user score to be derived from an identified change option to a cost of implementing the identified change option. The user is provided an ordered list of the identified change options organized by the relative cost benefit measure of each of the identified change options.

Web server 115 communicates with user datastore 170 and score data archive 160 to store and retrieve user data, results, scores and other related information. In an embodiment, a user is identified by a user identifier. Web server 115 operates with user datastore 170 to permit a user to retrieve previously stored information from user datastore 170 and to compare the user's scores to the scores of other users stored in user datastore 170.

Web server 115 also interacts with QOL rules engine 120 and with score data archive 160. Score data archive 160 comprises scores of celebrities, historical figures, ideal lifestyle measures and averages of lifestyle measure scores for a given community. Web server 115 operates with score data archive 160 to permit a user to compare scores of the user with scores stored in the score data archive 160.

In an embodiment, web server 115 interacts with advice server 175 to provide suggestions for improving scores. The advice may be provided automatically or a prompt may be displayed to the user offering advice on a particular QOL factor.

The operation of a QOL quantification system is illustrated in the following embodiments. However, the presentation of these embodiments are not meant to be limiting.

Figure 4:
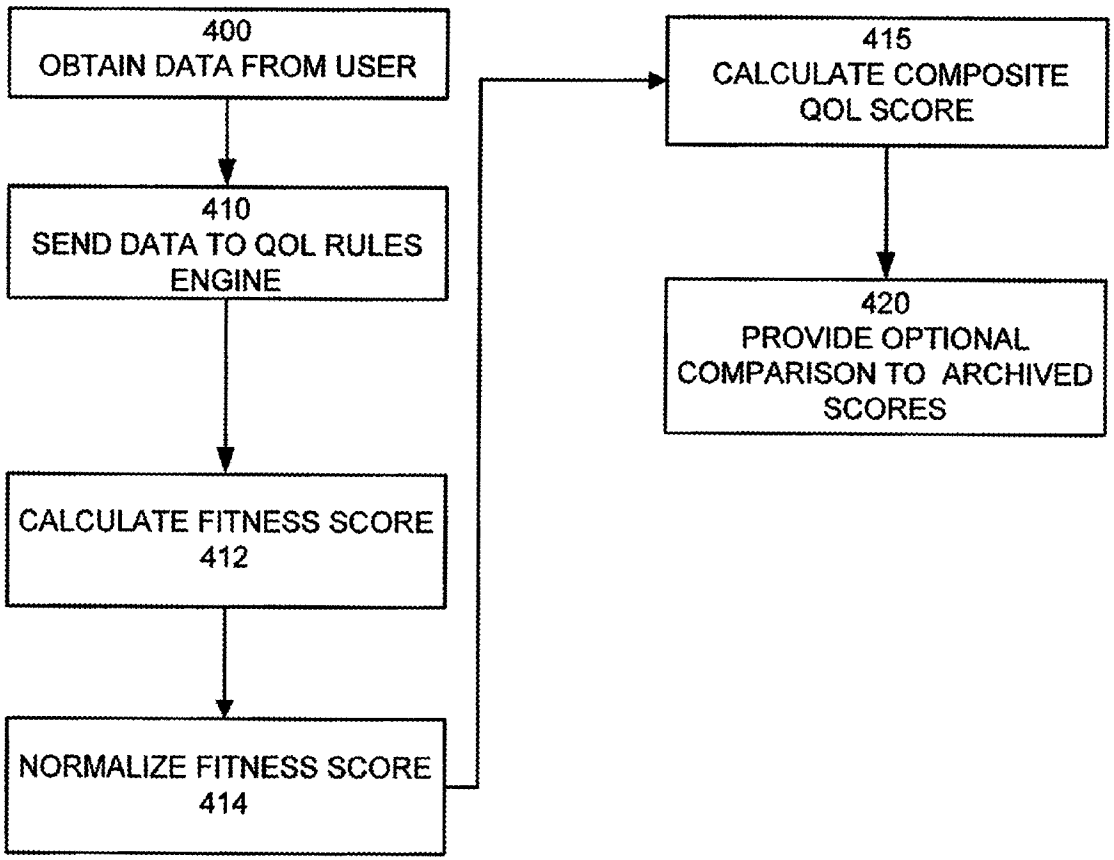
FIG. 4 illustrates the logical flow of a fitness evaluation routine according to an embodiment.

FIG. 4 illustrates a logical flow of a fitness evaluation routine according to an embodiment. The user selects "fitness" from a list of available lifestyle factors to evaluate via a GUI (FIG. 2, 220) and then answers a series of questions and provides other necessary data 400. The data are submitted to a QOL rules engine 410. The QOL rules engine accesses internal algorithms to calculate a composite fitness score 412 based on data provided by the user. The fitness score 412 is then normalized to a common QOL base 414 and used to calculate a composite QOL score 415. By way of illustration, the QOL rules engine calculates a healthy weight range for the user based on age, gender, and height as entered by user, and assigns a corresponding numeric score based on user's weight. The score for the user's weight is normalized so as to provide a common base of scoring thereby allowing combination with scores for other QOL measures, relationship, nutritional mental health, or other scored, which are also normalized to a common base, to provide a composite QOL score for user 415.

A user may request that the user's scores be compared with other scores in a score data archive 420. The score data archive comprises data of celebrities, historical figures, and ideal lifestyle factors. A user may also request that the user's scores be compared with archived scores 420.

Referring again to FIG. 4, in an embodiment, a QOL rules engine 410 evaluates multiple QOL factors simultaneously, via multivariate statistical techniques to calculate the composite score 415 relating to all factors requested by the user. By way of illustration, the QOL rules engine produces a composite fitness score based on fitness measures FIG. 1, 150 such as weight and exercise as well as non-fitness measures such as sleep measures FIG. 1, 142 and nutrition measures FIG. 1, 148. These scores are normalized so that they may be combined arithmetically or in a weighted fashion using multivariate techniques that may give differeng weights to different normalized scores to arrive at a QOL score for the individual.

Referring again to FIG. 1, in an embodiment, a user may also request that the user's scores be compared with scores of other users in user datastore 170. In an embodiment, a user may access another user's data in user datastore 170 only if the user knows the user identifier of the other user.

Optionally, the QOL rules engine may adjust a score based on additional information obtained from a user. By way of illustration and not as a limitation, the user may be asked:

Do you smoke?

Do you have a physical handicap that limits exercise?"

Do you belong to a gym?

The QOL quantification processor may lower scores for affirmative answers and raise them for negative answers.

Figure 5:
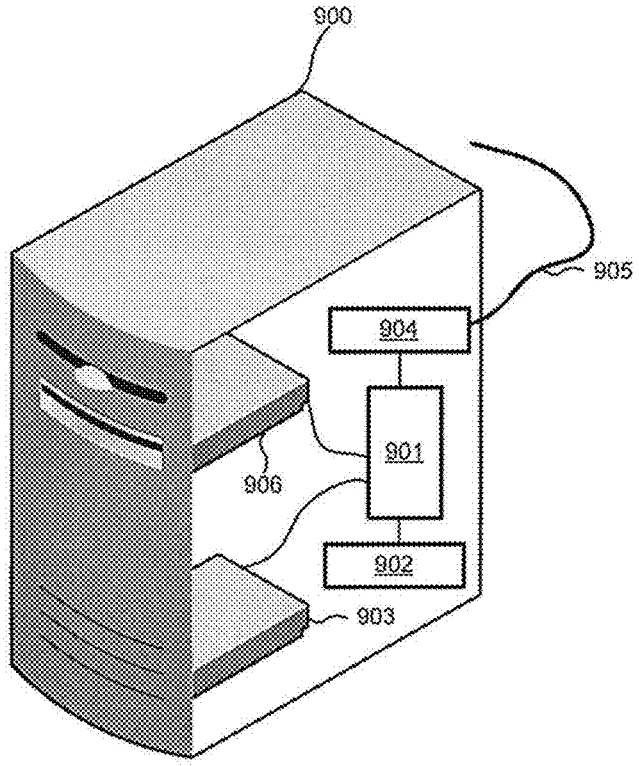
FIG. 5 illustrates embodiments having differeng system components.

A number of the embodiments described herein may be implemented with any of a variety of remote server devices, such as the server 900 illustrated in FIG. 5. Such a server 900 typically includes a processor 901 coupled to volatile memory 902 and a large capacity nonvolatile memory, such as a disk drive 903. The server 900 may also include a floppy disk drive and/or a compact disc (CD) drive 906 coupled to the processor 901. The server 900 may also include a number of connector ports 904 coupled to the processor 901 for establishing data connections with network circuits 905.

The various illustrative logical blocks, modules, circuits, and algorithm steps described in connection with the embodiments disclosed herein may be implemented as electronic hardware, computer software, or combinations of both that are dedicated to the processing of the various embodiments disclosed herein. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present invention.

The hardware used to implement the various illustrative logics, logical blocks, modules, and circuits described in connection with the aspects disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of the computing devices, e.g., a combination of a DSP and a microprocessor, a plurality of microprocessors, one or more microprocessors in conjunction with a DSP core, or any other such configuration. Alternatively, some steps or methods may be performed by circuitry that is specific to a given function.

In one or more exemplary embodiments, the functions described may be implemented in hardware, software, firmware, or any combination thereof. If implemented in software, the functions may be stored on or transmitted over as one or more instructions or code on a computer-readable medium. The steps of a method or algorithm disclosed herein may be embodied in a processor-executable software module which may reside on a computer-readable medium. Computer-readable media includes both computer storage media and communication media including any medium that facilitates transfer of a computer program from one place to another. A storage media may be any available media that may be accessed by a computer. By way of example, and not limitation, such computer-readable media may comprise RAM, ROM, EEPROM, CD-ROM or other optical disc storage, magnetic disk storage or other magnetic storage devices, or any other medium that may be used to carry or store desired program code in the form of instructions or data structures that may be accessed by a computer.

Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, DSL, or wireless technologies such as infrared, radio, and microwave are included in the definition of medium. Disk and disc, as used herein, includes compact disc (CD), laser disc, optical disc, digital versatile disc (DVD), floppy disk, and blu-ray disc where disks usually reproduce data magnetically, while discs reproduce data optically with lasers. Combinations of the above should also be included within the scope of computer-readable media. Additionally, the operations of a method or algorithm may reside as one or any combination or set of codes and/or instructions on a machine readable medium and/or computer-readable medium, which may be incorporated into a computer program product.

The preceding description of the disclosed embodiments is provided to enable any person skilled in the art to make or use the present invention. Various modifications to these embodiments will be readily apparent to those skilled in the art, and the generic principles defined herein may be applied to other embodiments without departing from the scope of the invention. Thus, the present invention is not intended to be limited to the embodiments shown herein but is to be accorded the widest scope consistent with the principles and novel features disclosed herein. Further, any reference to claim elements in the singular, for example, using the articles "a," "an," or "the," is not to be construed as limiting the element to the singular. The foregoing method descriptions and the process flow diagrams are provided merely as illustrative examples and are not intended to require or imply that the steps of the various embodiments must be performed in the order presented. As will be appreciated by one of skill in the art the order of steps in the foregoing embodiments may be performed in any order. Further, words such as "thereafter," "then," "next," etc. are not intended to limit the order of the steps; these words are simply used to guide the reader through the description of the methods.

What is claimed is:

1. A Quality of Life ("QOL") quantification system comprising:

a QOL rules engine;

a QOL measure datastore, wherein the QOL measure datastore comprises quantifiable measures of QOL factors;

a change option datastore; and a QOL score data archive, wherein the QOL score data archive comprises QOL score data for other users;

wherein the QOL rules engine comprises instructions for:

receiving user data corresponding to a selected QOL factor of the user;

obtaining measures of QOL from the QOL measure datastore that correspond to the selected QOL factor;

evaluating the user data against the QOL measures of the selected QOL factor to determine a user score indicative of the degree of quality of the selected QOL factor of the user;

receiving at least one change option selected from the change option datastore;

applying the at least one selected change option to the selected QOL factor; and determining an enhanced user score after application of the at least one selected change option.

2. The system of claim 1, wherein the at least one selected QOL factor is selected from the group consisting of sleep, relationships, mental health, nutrition, fitness, physical appearance and physical health.

3. The system of claim 1 wherein the measures of QOL are selected from the group consisting of sleep measures, relationship measures, mental health measures, nutrition measures, fitness measures, physical appearance measures, and physical health measures.

4. The system of claim 1 wherein the selection of the at least one change option is received from a user computing device operated by a user.

5. The system of claim 1, wherein the QOL rules engine further comprises instructions for selecting the at least one change option from the change option datastore.

6. The system of claim 5, wherein the QOL rules engine further comprises instructions for:

determining, for each of the at least one selected change options, a cost benefit measure indicative of a unit of improvement to the user score to be derived from an identified change option to a cost of implementing the identified change option; and providing the user an ordered list of the one or more identified change options organized by relative cost benefit measure of each of the one or more identified change options.

7. A Quality of Life ("QOL") quantification system comprising:

a QOL rules engine;

a QOL measure datastore, wherein the QOL measure datastore comprises quantifiable measures of QOL factors; and a QOL score data archive, wherein the QOL score data archive comprises QOL score data for other users;

wherein the QOL rules engine comprises instructions for:

receiving user data corresponding to a plurality of QOL factors of the user;

obtaining measures of QOL from the QOL measure datastore that correspond to each of the plurality of QOL factors;

evaluating the user data against the QOL measure of each of the plurality of QOL factors to determine a composite user score indicative of the QOL of the user;

receiving at least one change option selected from the change option datastore for a QOL measure selected from the plurality of QOL factors;

applying the at least one selected change option to the selected QOL factor; and determining an enhanced composite user score after application of the at least one selected change option.

8. The system of claim 7, wherein the plurality of QOL factors is selected from the group consisting of sleep, relationships, mental health, nutrition, fitness, physical appearance and physical health.

9. The system of claim 7, wherein the measures of QOL are selected from the group consisting of sleep measures, relationship measures, mental health measures, nutrition measures, fitness measures, physical appearance measures and physical health measures.

10. The system of claim 7, wherein the selection of the at least one change option is received from a user computing device operated by a user.

11. The system of claim 7, wherein the QOL rules engine further comprises instructions for comparing the composite user score to a score stored in the QOL score data archive.

12. The system of claim 7, wherein the QOL rules engine further comprises instructions for comparing the enhanced composite user score to a score stored in the QOL score data archive.

13. The system of claim 7, wherein the QOL rules engine further comprises instructions for selecting the at least one change option from the change option datastore.

14. The system of claim 1, wherein the QOL rules engine further comprises instructions for comparing the user score to a score stored in the QOL score data archive.

15. The system of claim 1, wherein the QOL rules engine further comprises instructions for comparing the enhanced user score to a score stored in the QOL score data archive.

* * * * *